United States Patent [19]

Shelar et al.

[11] Patent Number: 4,819,668

[45] Date of Patent: Apr. 11, 1989

[54] CIGARETTE CUT FILLER CONTAINING RARE AND SPECIALTY TOBACCOS

[75] Inventors: Gary R. Shelar, Greensboro; Bruce R. Bullings, Winston-Salem, both of N.C.

[73] Assignee: R. J. Reynolds Tobacco Company, Winston-Salem, N.C.

[21] Appl. No.: 33,963

[22] Filed: Apr. 2, 1987

[51] Int. Cl.[4] ..... A24B 15/18

[52] U.S. Cl. ..... 131/371; 131/365

[58] Field of Search ..... 131/373, 371, 365

[56] References Cited

U.S. PATENT DOCUMENTS 3,136,321 6/1964 Davis ..... 131/371
3,316,919 5/1967 Green et al. .
4,421,126 12/1983 Gellatly .
4,452,257 6/1984 Cartwright et al. .

FOREIGN PATENT DOCUMENTS 910451 11/1962 United Kingdom .

*Primary Examiner*—V. Millin

[57] ABSTRACT

Rare or specialty cigar-type and pipe tobaccos can be uniformly applied within a blend of smokable material for use as cigarette cut filler. The rare or specialty tobacco is divided into a finely divided powder, suspended in liquid, and applied as a casing to one or more relatively major components of the blend. This invention provides for cigarette cut filler having low (e.g., less than about 5 weight percent) amounts of unique tobaccos contained uniformly throughout.

30 Claims, 1 Drawing Sheet

CIGARETTE CUT FILLER CONTAINING RARE AND SPECIALTY TOBACCOS

BACKGROUND OF THE INVENTION

This invention relates to smoking articles such as cigarettes, and in particular to the cut filler of such smoking articles.

Popular smoking articles such as cigarettes have a substantially cylindrical rod shaped structure and include a change of smokable material such as shredded tobacco, processed tobacco and/or reconstituted tobacco (e.g., cut filler) surrounded by a wrapper such as paper thereby forming a tobacco rod. It has become desirable to manufacture cigarettes having cylindrical filter elements aligned in an end-to-end relationship with the tobacco rod. Typically, filters are manufactured from fibrous materials such as cellulose acetate and are attached to the tobacco rod using a circumscribing tipping material.

Various types of tobaccos and other materials can be blended together to form the cut filler of a cigarette. Generally, various amounts of flue-cured, Burley, Maryland and Oriental tobaccos are blended together and ultimately form cut filler. A typical blend also can include reconstituted tobacco material, volume expanded processed tobacco, cut rolled stems, tobacco substitutes, and other such materials. The cut filler frequently is treated with additives such as humectants, casing (e.g., alcoholic solutions of sugars) and top dressing (e.g., alcoholic solutions of aromatic substances and flavorants). See British Pat. No. 910,451 to Davis.

Generally, the relatively large amounts of the respective blend components as well as the conventional techniques for providing casings and top dressings provide for blends which are relatively uniform. For this reason, it is possible for the manufacturer of cigarettes to produce large quantities of cigarettes as well as maintaining good quality control (i.e., the uniformity of the blends allow for the manufacture of cigarettes each of which exhibit similar taste characteristics). In addition, the uniformity of a blend provides the ability of the cigarette to exhibit a certain controlled taste characteristic from puff-to-puff during use.

Various so called "rare" and "specialty" tobaccos are available. Such tobaccos exhibit unique, distinctive, rich and flavorful taste characteristics to a cigarette when employed as cut filler in the smoking article. Examples of such tobaccos include the so called dark fired, latakia, perique, Northern Wisconsin, soakum, galpoa, Pennsylvania fermented and Green River tobaccos. Due to the unique taste characteristics of such tobaccos, it would be desirable to incorporate certain amounts of such tobaccos into cut filler for cigarettes.

Unfortunately, many of the rare or specialty tobaccos are expensive. Thus, it is desirable to incorporate small amounts of such tobaccos into a blend. In addition, the unique taste characteristics provided by such tobaccos require that such tobaccos be employed as relatively small amounts within a blend.

The rare or specialty tobaccos can be processed to have a form of cut filler. Such a form may not be highly desirable in those situations where the rare or specialty tobacco is employed in small amounts. In particular, small amounts of the rare or specialty tobacco cut filler within a blend may yield a cigarette which does not provide the unique taste of the particular tobacco type during certain puffs, while providing an overwhelming taste during other puffs.

It would be desirable to provide an efficient and effective manner or method for incorporating small amounts of rare or specialty tobaccos into a cigarette cut filler blend.

SUMMARY OF THE INVENTION

The present invention relates to a cigarette cut filler blend which contains relatively low amounts of one or more rare or specialty tobaccos (e.g., such as cigar-type or pipe tobaccos). The rare or specialty tobaccos are dispersed relatively uniformly throughout the cut filler. Thus, upon use of a cigarette containing the rare or specialty tobaccos, the desirable taste characteristic of those tobaccos are provided to the user in a well controlled manner (i.e., without being either totally nonexistent or overpowering during individual puffs).

In particular, the desired tobacco is provided in a small size, suspended in a liquid and applied to the one or more components of the blend. Preferably, a suspension of rare or specialty tobacco is applied to one or more components (e.g., smokable materials) of a cigarette blend using casing techniques. The present invention allows the skilled artisan to provide low amounts of dark fired, latakia, perique, Northern Wisconsin, soakum, galpoa, Pennsylvania fermented and/or Green River tobacco(s) to one or more components of a cigarette blend. Although relatively large amounts of finely divided tobacco can be applied to the smokable material, it is frequently desirable that up to about 5 percent by weight of the cigarette blend can be provided from one or more of the rare or specialty tobaccos. Generally preferred are cigarette blends which contain less than about 2.5 weight percent of the rare of specialty tobacco(s), and particularly from about 0.05 to about 1, preferably about 0.1 weight percent of the rare or specialty tobacco(s).

Surprisingly, the present invention allows the skilled artisan to efficiently and effectively provide unique tobacco blends having increased tobacco taste while employing low amounts of rare or specialty tobaccos. In addition, the highly uniform blends which result can be easily provided.

DETAILED DESCRIPTION OF THE EMBODIMENTS

Figure 1:
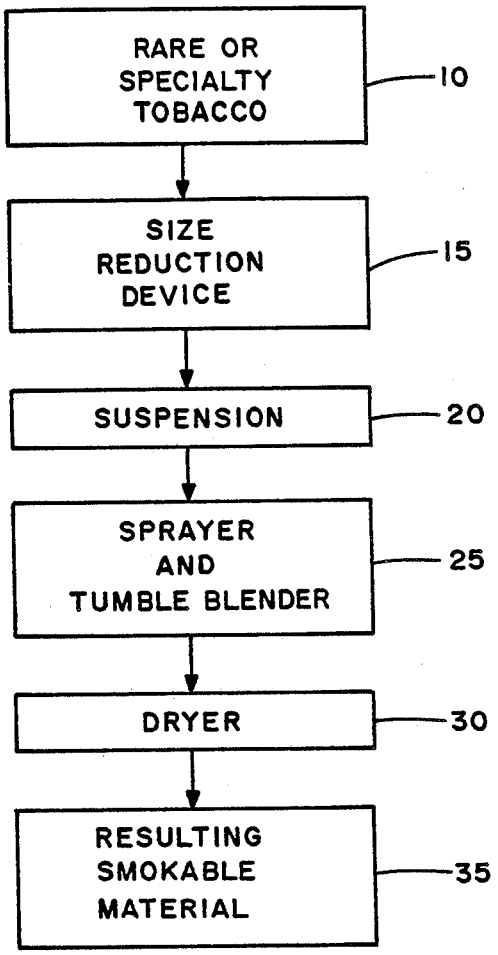
FIG. 1 is a schematic diagram of a preferred set of processing steps for this invention.

Referring to FIG. 1, the rare or specialty tobacco 10 can be provided in whole leaf form, as strip, as scrap, or any other suitable form. the tobacco 10 is divided to a small size using a size reduction apparatus 15 such as a ball mill or other means for grinding the tobacco to a small size. An example of a suitable device is a Sweco Mill available from Sweco Co. The size to which the tobacco is divided (e.g., ground) can vary and is most desirably such that the individually ground particulates are in the range from about 1 micron to about 30 microns in diameter. For example, the tobacco can be ground to a size such that about 100 weight percent thereof passes through a 100 mesh screen and more than about 95 weight percent thereof passes through a 200 mesh screen. Generally, the tobacco is reduced in size to provide a powder, preferably in essentially dry form (e.g., having a moisture content of about 3 to about 8 percent by weight).

A suspension 20 is formed from the finely divided tobacco and a liquid. Typically, the liquid is water, a mixture of water and glycerin, or the like. The liquid can have certain flavorants normally employed as casing materials incorporated therein. For example, the liquid can contain licorice or cocoa additives in amounts readily apparent to the skilled artisan. The suspension is provided by contacting the divided tobacco and liquid, and shearing or otherwise mixing the materials. Typically, the liquid and divided tobacco can be mixed at above ambient temperatures (i.e., about 140° F.) using a mixer and conditions suitable for providing conventional casing compositions. The resulting suspension 20 can be strained in order to remove relatively large materials therefrom by passing the warm suspension through a 100 mesh screen, or the like. Typically, the slurry has a liquid content between about 60 weight percent and about 95 weight percent. Preferably, the finely divided tobacco and liquid which thus form the suspension have a character suitable for spraying.

The suspension 20 of divided tobacco in liquid can be applied essentially as is a conventional casing composition using an application means 25. For example, the heated, agitated suspension is applied using a spray nozzle to tobacco strip in a conventional tumbling drum, or the like. Preferably, the suspension is applied using a pressurized sprayer while the suspension is warm (i.e., having a temperature greater than about 100° F.). The rate of application of the suspension, the rate of tumbling of the tobacco material, and other such conditions are essentially comparable to those employed during application of a conventional casing composition to tobacco material. In such a manner, the low amount of selected tobacco can be applied essentially uniformly to at least a portion of the smokable material of the blend.

Generally, the resulting tobacco material treated with the suspension has a moisture content greater than about 30 weight percent, frequently about 35 weight percent. The moist tobacco material is dried in a drying apparatus 30 in order to yield a resulting material having a moisture content of from about 10 weight percent to about 15 weight percent, preferably about 13 weight percent. The drying apparatus 30 can be any drying unit conventionally employed for drying cased tobacco strip. Typically, the moist tobacco material is heated at about 280° F. for less than about 30 seconds in order to provide a tobacco material having the desired moisture level.

The resulting smokable material 35 typically has the general appearance of cased tobacco material, is generally non-dusting and has a good consistency. The resulting material can be employed in further processing and blending steps for providing cigarette cut filler. In particular, the smokable material is employed in the manufacture of cigarettes.

A suitable blend of tobacco material can be provided by first providing a suspension of finely ground latakia tobacco in an aqueous liquid (e.g., 1 weight part latakia dust, 10 weight parts water and 1.5 weight parts glycerin are mixed to form a slurry at about 140° F.). The suspension is applied as a casing to 15 weight parts Burley tobacco strip, followed by oven drying to provide Burley strip having a moisture content of about 13 weight percent. The Burley strip having the finely divided latakia tobacco so applied thereto is blended with 25 weight parts flue-cured tobacco strip, about 20 weight parts Oriental tobacco strip and about 25 weight parts reconstituted tobacco strip. The resulting strip is shredded to produce cut filler, and can be blended with volume expanded tobacco (e.g., about 15 weight parts volume expanded cut filler). The blending of the Burley tobacco (i.e., a major component of the blend) within the smokable blend provides for a relatively even distribution of the latakia tobacco throughout the blend.

What is claimed is:

1. A process for applying low amounts of at least one type of tobacco relatively uniformly within a blend of smokable material for use as cigarette cut filler, the process comprising:

(i) providing at least a portion of the smokable material for the blend;

(ii) providing a suspension of a selected tobacco material in finely divided particulate form within a liquid; and (iii) applying the suspension as a casing to the smokable material.

2. The process of claim 1 whereby the smokable material is employed for the manufacture of cigarettes.

3. The process of claim 2 whereby the selected tobacco material includes at least one of latakia, dark fired, perique, Northern Wisconsin, soakum, galpoa, Pennsylvania fermented or Green River tobaccos.

4. The process of claim 2 whereby the smokable material is Burley tobacco strip.

5. The process of claim 2 whereby about 0.05 weight percent to about 1 weight percent of the resulting blend is provided by the selected tobacco material.

6. The process of claim 2 whereby the liquid is an aqueous liquid.

7. The process of claim 2 whereby the selected tobacco material has a particle size in the range from about 1 micron to about 30 microns.

8. The process of claim 2 whereby the suspension is applied as a spray.

9. The process of claim 1 whereby the selected tobacco material includes at least one of latakia, dark fired, perique, Northern Wisconsin, soakum, galpoa, Pennsylvania fermented or Green River tobaccos.

10. The process of claim 9 whereby the smokable material is Burley tobacco strip.

11. The process of claim 10 whereby the suspension so provided is provided at above ambient temperature, strained at above ambient temperature, and applied as a suspension to the smokable material at above ambient temperature.

12. The process of claim 9 whereby about 0.05 weight percent to about 1 weight percent of the resulting blend is provided by the selected tobacco material.

13. The process of claim 9 whereby the selected tobacco material has a particle size in the range from about 1 micron to about 30 microns.

14. The process of claim 9 whereby the suspension is applied as a spray.

15. The process of claim 9 whereby the suspension is applied to the smokable material while the temperature of the suspension is greater than 100° F.

16. The process of claim 9 further comprising drying the smokable material and applied tobacco material to a moisture content between about 10 weight percent and about 15 weight percent after the suspension of finely divided selected tobacco material in liquid has been applied to the smokable material.

17. The process of claim 9 whereby the suspension so provided is provided at above ambient temperature, strained at above ambient temperature, and applied as a suspension to the smokable material at above ambient temperature.

18. The process of claim 1 whereby the smokable material is Burley tobacco strip.

19. The process of claim 18 whereby the suspension so provided is provided at above ambient temperature, strained at above ambient temperature, and applied as a suspension to the smokable material at above ambient temperature.

20. The process of claim 1 whereby about 0.05 weight percent to about 1 weight percent of the resulting blend is provided by the selected tobacco material.

21. The process of claim 1 whereby the liquid is an aqueous liquid.

22. The process of claim 21 whereby the suspension is applied to the smokable material while the temperature of the suspension is greater than 100° F.

23. The process of claim 21 further comprising drying the smokable material and applied tobacco material to a moisture content between about 10 weight percent and about 15 weight percent after the suspension of finely divided selected tobacco material in liquid has been applied to the smokable material.

24. The process of claim 23 whereby the selected tobacco material which is suspended in the aqueous liquid has a particle size in the range from about 1 micron to about 30 microns.

25. The process of claim 1 whereby the selected tobacco material has a particle size in the range from about 1 micron to about 30 microns.

26. The process of claim 1 whereby the suspension is applied as a spray.

27. The process of claim 1 whereby the suspension is applied to the smokable material while the temperature of the suspension is greater than 100° F.

28. The process of claim 1 further comprising drying the smokable material and applied tobacco material to a moisture content between about 10 weight percent and about 15 weight percent after the suspension of finely divided selected tobacco material in liquid has been applied to the smokable material.

29. The process of claim 28 whereby the suspension so provided is provided at above ambient temperature, strained at above ambient temperature, and applied as a suspension to the smokable material at above ambient temperature.

30. The process of claim 1 whereby the suspension so provided is provided at above ambient temperature, strained at above ambient temperature, and applied as a suspension to the smokable material at above ambient temperature.

* * * * *

UNITED STATES PATENT AND TRADEMARK OFFICE

CERTIFICATE OF CORRECTION

PATENT NO. : 4,819,668

DATED : April 11, 1989

INVENTOR(S) : Shelar et al

It is certified that error appears in the above-identified patent and that said Letters Patent is hereby corrected as shown below:

Column 1, line 31, please delete "alcoholic" and insert "aqueous".

Column 2, line 36, please delete "of" and insert "or".

Column 2, line 55, please delete "the" and insert "The".

Signed and Sealed this

Twenty-seventh Day of March, 1990

*Attest:*

JEFFREY M. SAMUELS

*Attesting Officer*

*Acting Commissioner of Patents and Trademarks*